US005196032A

United States Patent [19]

Oschatz

[11] Patent Number: 5,196,032

[45] Date of Patent: Mar. 23, 1993

[54] PROCESS FOR WET-ON-WET MERCERIZATION AND DYEING OF CELLULOSE MATERIAL WITH REACTIVE DYES

[75] Inventor: Christian Oschatz, Schallbach, Fed. Rep. of Germany

[73] Assignee: Sandoz Ltd., Basle, Switzerland

[21] Appl. No.: 697,866

[22] Filed: May 9, 1991

[30] Foreign Application Priority Data

May 11, 1990 [DE] Fed. Rep. of Germany ..... 4015133
Jan. 18, 1991 [DE] Fed. Rep. of Germany ..... 4101371

[51] Int. Cl.[5] ..... D06P 3/60; D06B 3/18; D06H 1/10; D06M 11/38

[52] U.S. Cl. ..... 8/543; 8/125; 8/127; 8/549; 8/918

[58] Field of Search ..... 8/549, 125, 543

[56] References Cited

U.S. PATENT DOCUMENTS

| | | | |
|---|---|---|---|
| 2,802,670 | 6/1959 | Alsberg et al. | 8/549 |
| 2,892,671 | 6/1959 | Alsberg et al. | 8/549 |
| 3,663,156 | 5/1972 | Meinger et al. | 8/601 |
| 4,862,713 | 9/1989 | Kutz et al. | 68/21 |
| 4,872,325 | 10/1989 | Moser et al. | 68/200 |
| 4,878,365 | 11/1989 | Kutz et al. | 68/9 |
| 4,997,453 | 3/1991 | Kutz et al. | 8/502 |

FOREIGN PATENT DOCUMENTS

| | | |
|---|---|---|
| 249022 | 12/1987 | European Pat. Off. . |
| 418214 | 3/1991 | European Pat. Off. . |
| 838336 | 6/1960 | United Kingdom . |
| 982255 | 2/1965 | United Kingdom . |
| 1060734 | 3/1967 | United Kingdom . |
| 1238913 | 7/1971 | United Kingdom . |
| 8301261 | 4/1983 | World Int. Prop. O. . |

*Primary Examiner*—A. Lionel clingman
*Attorney, Agent, or Firm*—Gerald D. Sharkin; Richard E. Vila; Thomas C. Doyle

[57] ABSTRACT

1. A process comprising a) a two liquor process for treating a cellulosic substrate with alkali and applying a dye to the substrate characterized by pad treating the substrate with alkali and dyeing by pad dyeing or printing with a reactive dyestuff without an intermediate washing step; or b) a one liquor process for treating a cellulosic substrate with alkali and a dye characterized in that the substrate is pad treated with alkali and reactive dye.

28 Claims, No Drawings

PROCESS FOR WET-ON-WET MERCERIZATION AND DYEING OF CELLULOSE MATERIAL WITH REACTIVE DYES

The invention relates to a one liquor or two liquor wet-on-wet alkali treatment (mercerization) and dyeing of cellulose material.

Up until now it has been impossible to dye and mercerize consecutively except with a separate washing and drying step inbetween. For example, it was necessary to have an independent pre-treatment process such as singeing, washing, de-sizing, bleaching, alkali treatment or mercerization after which the material had to be washed very well and then dried before being dyed (by a continuous process).

Continuous dye processes include cold dwelling processes, warm dwelling processes, pad steam processes, pad dry processes and pad thermofixation processes.

It is well known that by mercerizing a material there is an improvement in fiber affinity as well as swelling of the fiber which results in the following advantages:

High affinity to dyeing
Improved mercerizing sheen
Soft flowing handle
Improvement of the dyeing of immature/dead cotton
Less crinkling of tubular form goods by processes such as washing
Even, level and clear structural form and goods form
No concentration at the edges of knitted goods and no spiral
Stretching in the case of single jersey
Improved good dimensional stability and
The ability to use less fluid during wash treatments.

Up until now mercerization has had to be carried out in a single step that is then terminated and the product is then washed well, soaped, washed again and dried. This can be costly as well as time consuming.

According to the invention there is provided a) a two liquor process for treating a cellulosic substrate with alkali and applying a dye to the substrate characterized by pad treating the substrate with alkali (also known as caustification) and dyeing by pad dyeing or printing with a reactive dyestuff without an intermediate washing (and preferably also drying) step; or b) a one liquor process for treating a cellulosic substrate with alkali and a dye characterized in that the substrate is pad treated with alkali and a reactive dye preferably to give a weight increase of 55–200% based on the dry weight of substrate treated.

For the avoidance of doubt, in a process according to the invention alkali treatment is preferably carried out first followed by dyeing. However dyeing may be carried out first followed by alkali treatment.

Dyestuffs that can be applied to the substrate in a process according to the invention are preferably dyestuffs which are not affected by alkali, more preferably those which can be used under alkali treatment conditions without loss due to hydrolysis when they are applied and fixed on the goods.

Preferably the dyestuffs applied in a process according to the invention are selected from cold dyeing reactive dyes.

Preferred reactive dyestuffs are those of the following series:

difluoromonochloropyrimidine,
dichloroquinoxaline,
methylsulphonylchloromethylpyrimidine and monofluorotriazine and
combinations thereof with other reactive systems which are reactive dyes with two (optionally different) reactive group called the double anchor system reactive dyestuffs.

More preferred are the reactive dyes of the difluoromonochloropyrimidine series.

Preferably the substrate is a cellulosic fibrous substrate, which preferably includes cotton.

Preferably in a two liquor process, in the first treatment step (be it dyeing or alkali treatment), the increase in weight of the substrate is preferably 50–110%, more preferably 60–100% by weight and in the second step preferably 5–110%, more preferably 20–110%, most preferably 20–60% to give a total weight increase of 55–200% preferably 60–200%, more preferably 65–200%, most preferably 70 to 150%, especially 75–110%, due to take up of alkali and dyestuff liquor.

In a one liquor process the total weight increase is preferably 65–200%, more preferably 80 to 150%, especially 85 to 110%, due to take up of alkali and dyestuff liquor.

If a printing paste is used to apply the dyestuff, preferably the amount of paste taken up is 5–15% based on the dry weight of the substrate.

The liquors can be used for impregnating the substrate using the apparatuses and processes which are described in U.S. Pat. No. 4,872,325 (=DOS 36 20 864), U.S. Pat. No. 4,878,365 (=DOS 37 33 997) and U.S. Pat. No. 4,862,713 (=DOS 37 33 996). The contents of these U.S. patents are incorporated herein by reference.

In particular preferably a Flex Nip Apparatus is used for applying one or both liquors to the substrate. The Flex Nip Apparatus is described in the abovementioned U.S. patents.

The increase in weight is given in this specification is a weight increase based on the weight of substrate prior to treatment by a process according to the invention.

With woven goods it is desired to have a smaller amount of liquor take up (preferably 50–110% in total) whereby with knitted goods a larger dry weight addition is required (preferably 100–200%).

A process according to the invention may be carried out in a single liquor process or in a two liquor process. In this specification for the avoidance of doubt, a printing paste is defined to be a liquor.

Preferably a process according to the invention is a two liquor process. This is because for the single liquor process only a small number of dyestuffs are suitable, as such dyestuffs must be very highly stable to hydrolysis and electrolyte.

Preferably a dye fixing step is carried out at the end of a process according to the invention.

A process according to the invention enables caustification/mercerization and dyeing to be carried out without an intermediate washing and preferably drying treatment and produces brilliant deep dyeings where there has been a good takeup of dye.

The term "alkali treatment" includes primarily mercerization.

Alkali treatment is preferably carried out using aqueous liquors of an alkali of a specific concentration. Preferred alkalis are sodium and potassium hydroxide (and mixtures thereof). The preferred alkali is potassium hydroxide.

In a process according to the invention, the alkali liquor preferably has an alkalinity of 5° to 52° Be, more preferably 5° to 32° Be, most preferably 20° to 30° Be.

The hydroxide can in part be replaced by salt, in which case the alkalinity of the liquor is most preferably from 6° to 25° Be.

Preferably, in a process according to the invention the alkali liquor comprises 120 to 400 g/L of an alkali metal hydroxide (sodium and/or potassium hydroxide) more preferably 200 to 400 g/L of potassium hydroxide.

It has also been found when a part of the alkali is replaced by a salt, this is preferably a salt of the particular alkali metal. In the case of the preferred alkali, potassium hydroxide, it is a potassium halide salt, preferably potassium chloride.

Preferably, in a process according to the invention where part of the alkali is replaced by a corresponding salt, the ratio of alkali to salt is from 10:1 to 1:10, more preferably 3:1 to 1:10, most preferably 3:1 to 1:3.

If fixation is carried out by a heat treatment process for example steaming at 100°-150° C., 10 to 50% of the potassium hydroxide can be replaced by potassium chloride.

A preferred process according to the invention comprises applying an alkali liquor to a cellulosic substrate and allowing the substrate to dwell in the liquor for 3 to 30 seconds to allow swelling of the substrate to occur, removing excess alkali from the substrate and then applying the dye by dye padding or printing.

In principle, in a two liquor process, alkali treatment can be carried out first followed by dyeing or dyeing can be carried out first followed by alkali treatment. Preferably, however, alkali treatment is carried out first.

Preferably in a process according to the invention further assistants can be added to the alkali treatment liquor, preferably those used in normal dyeing processes.

In a process according to the invention further assistants are added to the alkali treatment liquor, selected from a) complex formers, which are capable of sequestering heavy metals without affecting metal containing dyestuff, optionally together with a dispersing agent, b) lubricating agents, dispersing agents and optionally retarders/leveling agents for reactive dyestuffs, and c) alkali metal silicate.

Preferably in a process according to the invention, in the alkali treatment liquor one or more wetting agents are used to give a quick and even wetting of the goods with the alkali treatment agent. When wetting agent (or mixture of wetting agents) is used, the amount used is 0.1 to 10 g/L, more preferably 2-6 g/L is used.

In the alkali liquor, further assistants may be added including complex formers, which are capable of sequestering heavy metals without affecting metal containing dyestuff while being effective at the abovementioned alkali conditions. It can be advantageous to use a complex former together with a dispersing agent, particularly anionic dispersing agent, for example a sulfonated fatty acid amide. An example of such a mixture is an aqueous composition comprising 15% by weight of sodium gluconate and 5% by weight of a sulfonated fatty acid amide.

The complex formers (optionally with a dispersing agent) are preferably used in amount up to 40 g/L depending on the hardness of the water. Preferably complex formers are used in the amount of 0.2-20, more preferably 0.5-10, most preferably 2.5 to 5 g/L.

In a process according to the invention, the alkali treatment liquor can also contain a lubricating agent. These lubricating agents can act as dispersing agents and optionally as retarders/leveling agents for reactive dyestuffs. Such agents are known. Preferably they are anionic active, for example sulfonated or sulfated castor oil.

When a lubricating agent is used, it is preferably used in the amount of 0.1 to 50 g/L, more preferably 1 to 15 g/L.

Furthermore the alkali treatment can contain the usual bleaching agents such as hydrogen peroxide.

When metal complex reactive dyestuffs are used, it is preferable not to use a complex former in the alkali treatment liquor.

In a process according to the invention, the dyestuff liquor may also contain usual dyeing assistants for example urea, retention agents, foam hindering agents and wetting agents.

In a process according to the invention, the alkali liquor can also contain alkali metal silicate preferably sodium or more preferably potassium silicate. In this case the alkalinity of the alkali treatment liquor is influenced by alkali metal hydroxide and alkali metal silicate. The amount of alkali metal silicate solution in the alkali treatment liquor can be as much as up to 200 ml/L of potassium silicate solution with an alkalinity of 38°-41° Be. Preferably however the amount of silicate solution present is 50-200 ml/L, more preferably 100-200 ml/L of preferably potassium silicate solution with an alkalinity of 38°-41° Be. The reason for adding the alkali metal silicate is primarily to stop any shrinkage of the goods during swelling.

The aqueous alkali treatment and dyeing liquors are preferably applied at a temperature from 10°-100° C., preferably 15°-80° C., most preferably 15°-40° C.

After applying the alkali treatment or dyeing processes, the goods can then be allowed to dwell for example in a fixing process until the desired alkali treatment effect has occurred or dyestuff fixing has taken place.

High increases in weight are usually due to the so called double padding processes of various types for example, the horizontal, vertical and the nip padding process (or various combinations thereof) or through apparatuses for spraying on dye, foam application, electrostatic dyestuff application or combinations of these with pad application of the alkali.

Such processes are carried out as follows. A bath containing the liquor is made up in a upright trough and the substrate contacted with a very small amount of a treatment liquor that is regularly topped up. The bottom of the trough is sealed by two horizontal lips located on either side of the trough (so that the side edges of the substrate for example in sheet form can be drawn through the trough between the parallel lips) that allows the liquor to be applied to the substrate to a particular grade of wetness. The particular advantage of this apparatus is the possibility of taking minimum alkali liquor into the next stage. A disadvantage of strong alkali in the dyeing bath could be causing undesirable reactions such as uncontrolled hydrolysis or affect the substantivity of the dye. A further advantage of the addition liquor application is that the solubility limits of the dyestuffs do not influence the dyeing depth and so dyeing depths can be made much greater.

By keeping the alkali liquor and the dyeing liquors separate, this the alkali treatment (mercerization) apparatus to be used for the dyeing fixation step.

A process of the present invention allows a fully continuous cold dwelling process to take place whereby dyestuff fixation can occur in a matter of minutes without the need for any heat energy (for example steaming or thermofixation), that is to say that fixing may be carried out at room temperature. All that is necessary is storage space for the substrate like a simple tray, a J box roller apparatus, an unheated steamer or empty roller containers. To do this however, usually requires the use of quick reacting reactive dyestuffs.

Preferably the alkali treatment and dyeing together with the optional dyestuff fixation of a process according to the invention are carried out as follows:

1. Cold and warm dwelling processes either comprising one or two phase wet in wet alkali treatment and dyeing steps followed by a short or long fixing time having a dwelling time of 30 seconds to 48 hours at temperature between 20°-230° C. in the air and/or under steam atmosphere, such as in a steam atmosphere of over 100° C. HT conditions or overheated steam at atmospheric pressure occurs.

Particularly preferred is the cold dwelling process with a dwelling time of 30 seconds to 48 hours, preferably 10 minutes to 48 hours. This treatment can also however be carried out according to a pad roll process or warm dwelling processes, with preferred temperatures in the range of 20°-100° C. with a dwelling time 30 seconds to 8 hours.

2. Pad Dry processes—one or two phase wet in wet alkali treatment and dyeing steps followed by a final dry fixing stage having dry temperatures of 100°-150° C. in warm air or under heated steam for 1 second to 30 minutes.

3. Pad Thermofixation processes—one or two phase wet in wet alkali treatment and dyeing steps followed by a thermofixation process at the end of the usual pad process is carried out as follows:

a) In warm air with temperatures from 100°-230° C. for a time period of 1 second to 30 minutes or
b) Under steam at temperatures between 100°-230° C. for 1 second to 30 minutes.

4. Pad steam processes—one or two liquor wet in wet alkali treatment and dyeing steps followed by a final steam process carried out as follows:

a) In saturated steam under normal pressure at 100° C. or
b) In saturated steam under superatmospheric pressure at a temperature of 100°-150° C.

Either process is carried out for the time period of 1 second to 30 minutes. After treatment the goods can be washed by known methods and dried. Preferably they are washed with demineralized (soft) water the washing can be carried out at temperatures between room temperature (20° C.) and boiling (100° C.), preferably at temperature between 60°-95° C. Where desired the goods can also be neutralized in a acid bath either at the end or before the washing occurs.

Bleaching agent may be added (preferably hydrogen peroxide) during the washing process.

A process according to the invention can be used to treat with alkali and dye all textile materials made of natural or regenerated cellulose fibers and mixtures thereof as well as mixtures of natural and/or regenerated fibers with synthetic fibers together with any special textile structural formations.

The substrates of preferred interest are:

Mixtures of cotton and regenerated cellulose fibers,
Cotton and regenerated cellulose fibers together with acrylic fibers or polyester.

The forms of preferred interest of the substrates are as follows:

Raw quality goods such as woven and knitted goods
Pre-treated woven or knitted goods and stitch work, especially stitch work in tubular form
Chain knitted garments and
Frotte, velvet and plush articles.

Where the substrate is raw cotton, the dead (or immature) cotton is also treated and dyed.

The agglommeration of alkali treatment and/or dye along the creases of pipe form goods is hindered. A further advantage of the process according to the invention is the possibility of treating the goods without tensioning them.

A particularly preferred method of wet in wet liquor application is what is known as the Flex-Nip-Conception. After the first liquor alkali treatment impregnation, the substrate is easily slidable and so it is also possible to recommend the Flex-Nip Apparatus for knitted goods. (Generally the use of Flex-Nip apparatus for knitted goods is usually not recommended due to too long a time under tensioning).

In this Specification any reference to g/L relates to the volume of liquor being used.

Further in this Specification, all weights are based on the dry weight of the material in question, unless indicated to the contrary.

In the Examples the wetting agent can be Sandozin NET or Sandozin EH (the former a nonionic wetting agent and the latter an anionic wetting agent from Fa. Sandoz), preferably Sandozin NET.

The invention will now be illustrated by the following examples in which all temperatures are in °C. unless indicated to the contrary. In the Examples "silicate" means "aqueous silicate solution".

EXAMPLE 1

A bleached 100% cotton fabric is padded according to a conventional double padding method wet in wet. In the first padding step an aqueous liquor is made up containing:

63 g/l of potassium hydroxide 100%
188 g/l of potassium chloride
100 g/l of sodium silicate having an alkalinity of 38° Be
50 g/l of a mixture of a commercially available alkali resistant wetting agent Sandozin NET and sodium gluconate/sulphonated fatty acid amine mixture.

The fabric is padded having a pickup of 72%. In the second padding step an aqueous liquor containing 30 g/l of CI Reactive Green 21 is made up and padding is carried out and a pickup of 31% results after which it is allowed to stand for 20 minutes at room temperature. The fabric is then washed and dried.

A level brilliant blue deep green is produced.

In contrast to conventional pad batch dyeings with two aqueous liquors, one containing:

50 g/l of sodium silicate
10 g/l of sodium hydroxide having an alkalinity of 36° Be; and the other containing
30 g/l CI Reactive Green 21 with an intermediate washing and drying step and standing for 24 hours. It can be seen that dyeing of Example 1 is substantially more brilliant (even though it only stands for 20 minutes) and the dyeing produced is a deeper green.

EXAMPLE 2

A bleached 100% cotton fabric is padded wet in wet with an addition liquor application process (Flex-Nip-Conception). A first padding step is carried out using an aqueous liquor containing:

125 g/l of potassium hydroxide 100%
125 g/l of potassium chloride
100 g/l of sodium silicate having an alkalinity of 38° Be
50 g/l of a aqueous mixture of a commercially available alkali resistant wetting agent and sodium gluconate/sulphonated fatty acid amide mixture.

This step results in an 80% pickup. A second padding step is carried out with a Flex-Nip apparatus (which is an additional liquor apparatus) having 40 g/l of CI Reactive Blue 225

This results in the material having a pickup of 26% to give a total of 106% weight addition. The material is allowed to stand at room temperature for 20 minutes, is washed and dried.

A level deep navy blue dyeing is produced which in comparison to conventionally produced pad batch dyeings with a washing and drying step using sodium silicate and sodium hydroxide and standing for 6 hours gives about a 4 times deeper dyeing.

EXAMPLE 3

A non-mercerized viscose fabric (regenerated cellulose) is padded wet in wet using the conventional padding process. In the first padding step an aqueous liquor containing 250 g/l of potassium hydroxide 100%
100 g/l of sodium silicate having an alkalinity of 38° Be
50 g/l of a mixture of a wetting agent with sodium gluconate/sulphonated fatty acid amide mixture (as in Example 1), is applied and in the second padding process an aqueous liquor of 40 g/l of C.I. Reactive Blue 225 is padded onto the fabric. From the first padding process 65% by dry weight addition is impregnated into the material and in the second padding process a 21% pickup is registered to give a total dry weight addition of 86%. This is allowed to stand at room temperature for 10 mins and is washed and dried.

A deep navy blue dyeing results which in comparison to conventionally produced pad batch dyeings with a washing and drying step carried out over 6 hours using the same dyestuff produces a dyeing that is 4 times deeper.

EXAMPLE 4

A non-mercerized viscose fabric is treated wet in wet with a conventional double padding process. In the first padding step an aqueous liquor is made up containing 220 g/l of potassium hydroxide 100%
30 g/l of potassium chloride
100 ml/l of sodium silicate having an alkalinity of 38° Be
50 ml/l of a mixture of a wetting agent with sodium gluconate/sulphonated fatty acid amide mixture (as in Example 1).

The second padding process is carried out using an aqueous liquor of 80 g/l C.I. Reactive Orange 69

From the first padding about 65% by weight is added and in the second padding step 23% is taken up giving a total weight addition of 88%. Without a drying process in between the padding and steaming procedure the material is steamed for 30 seconds at 102° C. under atmospheric pressure, after which it is washed and dried.

An even deep brilliant orange dyeing results which in comparison to a conventional pad batch dyeing with a washing and drying step over 6 hours with the same amount of dyestuff produces a nuance that is 4 times deeper.

EXAMPLE 5

Example 4 is repeated using a bleached 100% cotton fabric instead of the viscose fabric. The result is similar.

EXAMPLE 6

A non-mercerized cotton "renforce" fabric is padded using a bath containing 125 g/l of potassium chloride
125 g/l of potassium hydroxide 100%
100 g/l of sodium silicate having an alkalinity of 38° Be
50 g/l of a mixture of a wetting agent with sodium gluconate/sulphonated fatty acid amide mixture.

A pickup of 80% (based on the dry weight of the product) occurs with a dipping time of 20 seconds followed by a wet in wet application of a printing paste containing 40 g C.I. Reactive Blue 225
10 g sodium metanitrobenzenesulphonate
400 g of a 12% thickener derived from a starch ether and
580 g water.

This results in an additional pick up of 10% (based on the dry weight of the material) when printed with a stencil. Finally it is allowed to stand for 30 minutes in the cold, is washed and dried.

A deep navy blue printing results which in comparison to a conventional direct printing of following process.

1. Printing using a stencil with the following printing paste:

400 g of a starch ether 12%
10 g of sodium metanitrobenzenesulphonate
40 g of C.I. Reactive Blue 225 and
580 g water which results in a paste takeup based on the dry weight of material of 40%.

2. Followed by drying at 110° C.
3. Then padding over with a bath of 650 g water
200 g calcined soda
200 g Glauber salt and topped off with water to give 1000 g.

This is allowed to stand for 30 minutes in the cold after which the material is saponifed, washed and dried.

The dyeing of Example 6 is four times deeper and more brilliant.

EXAMPLE 7

A bleached 100% cotton fabric is impregnated wet and wet using an addition liquor process (Flex-Nip-Conception). In the first conventional padding a bath containing 100 g/l sodium silicate having an alkalinity of 38°–41° Be
250 g/l potassium hydroxide 100%
50 g/l of an aqueous mixture containing 0.25 g/l of a commercially available anionic wetting agent and
1 g/l of sodium gluconate/sulphonated fatty acid amide mixture for 20 seconds dipping.

After 25 seconds a second liquor application apparatus Flex-Nip with 50 g/l C.I. Reactive Red 147 is used to pad the material. From the first process step 96% by weight is impregnated and in the second process step 60% is further impregnated into the material giving a total pick up of 156% by dry weight addition. The material is then fixed for 10 minutes at room temperature, washed and dried.

A brilliant deep red and level dyeing with typical mercerising effects results. Compared to a conventional pad batch dyeing with 50 g/l C.I. Reactive Red 147
50 g/l of sodium silicate having an alkalinity of 38°–41° Be and
11 g/l of NaOH having alkalinity of 36° Be which is allowed to stand for 24 hours, the dyeing of Example 7 does not only produce significantly more brilliant dyeing but the dyeing has up to 20% more depth.

EXAMPLE 8

Example 7 is repeated using instead of the Flex-Nip apparatus a conventional padding process with soft rollers (50° Sh) whereby the mercerizing padding gives a pick-up of 69% and the second step (dyeing with padding with soft rollers and a low squeezing pressure) results in a further pick-up of 119% (Pick-up difference of 50%). This is allowed to stand for 10 minutes. Compared to conventional pad batch methods this produced not only a more brilliant dyeing but up to 20% deeper red dyeing.

EXAMPLE 9

A bleached 100% cotton fabric is padded with an addition bath process (Flex-Nip Conception). In a first padding step an aqueous liquor is made up containing 250 g/l potassium hydroxide 100%
50 g/l of an aqueous mixture containing
0.25 g/l of a commercially available anionic cross-linking agent and sodium gluconate/sulphonated fatty amide mixture.

A second liquor is made up in an application apparatus (Flex-Nip) containing 50 g/l of C.I. Reactive Blue 136, a low reactive exhaust reactive dyestuff.

From the first step, there is an 88% pick-up and from the second step there is a further take up of 52% giving a total of 140% dry weight addition. Finally the dyeing is allowed to stand at room temperature for 24 hours, washed and dried.

A very brilliant level green dyeing with typical mercerization effects results.

EXAMPLE 10

Example 9 is repeated using instead of the cold standing process a steam fixing process with a steaming time of 1 minute to fix the dyestuff. In this case a level very brilliant green dyeing results having typical mercerization effects.

EXAMPLE 11

A bleached 100% cotton woven piece is padded wet in wet using an addition liquor process (Flex-Nip Conception). A first aqueous padding liquor is made up containing 100 g/l of sodium silicate having an alkalinity of 38°–41° Be
300 g/l potassium hydroxide 100%
50 g/l of an aqueous mixture containing
0.25 g/l of a commercially available anionic cross-linking agent and
1 g/l of sodium gluconate/sulphonated fatty amide mixture.

A second liquor is made up in an addition application apparatus (Flex-Nip) containing 40 g/l of C.I. Reactive Golden Yellow 125 R, a highly reactive dyestuff.

From the first application step 95% by dry weight is impregnated into the piece and in the second step 105% is impregnated into the piece giving a total of 200% dry weight addition. Finally the material is allowed to stand at room temperature 10 minutes.

Compared to conventional pad batch dyeing with 40 g/l C.I. Reactive Golden Yellow 125 R
50 g/l of sodium silicate having an alkalinity of 38° Be
10 g/l of sodium hydroxide having an alkalinity of 36° Be and standing to 24 hours, the dyeing of example 11 is not only more brilliant but also requires 10 minutes standing to give a deeper dyeing.

EXAMPLE 12

A 100% cotton woven fabric which has been bleached is, in a single liquor, padded with a mercerizing and dyeing aqueous liquor containing 40 g/l C.I. Reactive Red 190
200 g/l of potassium hydroxide 100%
100 g/l sodium silicate having an alkalinity of 38°–41° Be
50 g/l of a mixture of a wetting agent and sodium gluconate/sulphonated fatty amide mixture.

There is 151% by dry weight take-up and the fabric is allowed to stand at room temperature for 6 hours after which it is washed and dried.

The resulting dyeing is a brilliant deep red and level dyeing having typical mercerization effects. Compared to a conventional dyeing it is possible to have a dyestuff increase of 20% (colormetrically measured).

A similar dyeing results when one uses, instead of 200 g/L of KOH, 100 g/l of sodium hydroxide and 100 g/l of potassium chloride or 70 g/l of potassium hydroxide and 130 g/l of potassium chloride.

EXAMPLE 13 AND 14

Example 12 can be repeated using C.I. Reactive Blue 13 or C.I. Reactive Red 13. Furthermore it is possible to replace up to two thirds of the potassium hydroxide by potassium chloride.

In all the examples all increases in weight are based on the dry weight of substrate that is treated at the start of the example.

What is claimed is:

1. A two liquor process for the alkali treatment and dyeing of a cellulosic fibrous substrate which comprises pad treating the substrate with an aqueous alkali liquor and, without an intermediate washing or drying step, dyeing the alkali treated substrate by pad dyeing or printing with an aqueous liquor containing a reactive dyestuff, said aqueous alkali liquor comprising alkali hydroxide and having an alkalinity of 20° to 30° Bé or comprising a mixture of alkali hydroxide and salt in a ratio from 10:1 to 1:10 and having an alkalinity of 6° to 25° Bé.

2. A process according to claim 1 in which the reactive dyestuff is selected from the difluoromonochloropyrimidine,
dichloroquinoxaline,
methylsulphonylchloromethylpyrimidine and
monofluorotriazine series and combinations thereof with other reactive systems which are known as the double anchor system reactive dyestuffs.

3. A process according to claim 1 in which the alkali treatment liquor is selected from sodium and potassium hydroxide and mixtures thereof.

4. A process according to claim 3 in which the alkali includes potassium hydroxide which optionally is partly replaced by KCl.

5. A process according to claim 3 in which a part of the alkali is replaced by a salt.

6. A process according to claim 1 in which further assistants are added to the alkali treatment liquor, selected from a) complex formers, which are capable of sequestering heavy metals without affecting metal containing dyestuff, optionally together with a dispersing agent,
b) lubricating agents, dispersing agents and optionally retarders/leveling agents for reactive dyestuffs, and
c) alkali metal silicate.

7. A process according to claim 1 in which a dye fixing step is carried out at the end of the alkali treatment and dyeing.

8. A process according to claim 1 in which the alkali treatment is mercerization.

9. A process according to claim 1 in which the dyestuff liquor contains dyeing assistants selected from urea, retention agents, foam hindering agents and wetting agents.

10. A process according to claim 1 in which aqueous alkali treatment and dyeing liquors are applied at a temperature from 10°-100° C.

11. A process according to claim 1 which comprises allowing the substrate to dwell in the alkali liquor for 3 to 30 seconds to allow swelling to occur, removing excess alkali from the substrate and then applying the dye by pad dyeing or printing.

12. A process according to claim 1 in which the increase in weight of the substrate is 50-110% in the first step and 5-110% in the second step, to give a total weight increase of 55-200% due to takeup of alkali and dyestuff liquor.

13. A process according to claim 1 wherein the alkali liquor has an alkalinity of 20° to 30° Bé.

14. A process according to claim 1 wherein the reactive dye is a cold dyeing reactive dye.

15. A process according to claim 14 wherein the treatment with alkali is carried out so as to give an increase in the weight of the substrate of 50 to 110% and the dyeing is carried out so as to give increase of 5 to 110%, so as to give a total weight increase, based on the dry weight of the substrate, of 60 to 200% due to takeup of alkali and dyestuff liquor.

16. A process according to claim 15 wherein the dyestuff is selected from dyes of the difluoromonochloropyrimidine, dichloroquinoxaline, methylsulphonylchloromethylpyrimidine and monofluorotriazine series and combinations thereof with double anchor system reactive dyestuffs.

17. A process according to claim 16 wherein the dyestuff is a reactive dye of the difluoromonochloropyrimidine series.

18. A process according to claim 17 wherein a dye fixing step is carried out at the end of the alkali treatment and dyeing.

19. A process according to claim 18 wherein the alkali treatment liquor contains 0.1 to 10 g/L of a wetting agent.

20. A process according to claim 16 wherein the alkali treatment and dyeing liquors are applied at a temperature of 15°-40° C.

21. A process according to claim 15 wherein the alkali treatment and dyeing liquors are applied at a temperature of 15°-80° C.

22. A process according to claim 1 wherein the alkali treatment and dyeing liquors are applied at a temperature of 15°-80° C.

23. A process according to claim 1 wherein the alkali hydroxide is sodium hydroxide or potassium hydroxide and the salt is a salt of the alkali metal of the alkali hydroxide.

24. A process according to claim 4 which further comprises carrying out a heat treatment step after the dyeing step to fix the dye.

25. A process according to claim 15 wherein the alkali liquor comprises a mixture of alkali hydroxide and salt having an alkalinity of 6° to 25° Bé.

26. A process according to claim 25 which further comprises carrying out a heat treatment step after the dyeing step to fix the dye.

27. A process according to claim 26 wherein the alkali liquor comprises a mixture of sodium hydroxide and a sodium salt or a mixture of potassium hydroxide and a potassium salt.

28. A process according to claim 26 wherein the alkali liquor comprises a mixture of potassium hydroxide and potassium chloride.

* * * * *